US006568344B2

(12) United States Patent
Burlet

(10) Patent No.: US 6,568,344 B2
(45) Date of Patent: May 27, 2003

(54) COMBINED BOAT-TRAILER APPARATUS

(76) Inventor: Mathias Burlet, 4801 Lakeview Dr., Miami Beach, FL (US) 33140

( * ) Notice: Subject to any disclaimer, the term of this patent is extended or adjusted under 35 U.S.C. 154(b) by 0 days.

(21) Appl. No.: 09/881,380

(22) Filed: Jun. 14, 2001

(65) Prior Publication Data

US 2002/0014195 A1 Feb. 7, 2002

Related U.S. Application Data

(63) Continuation-in-part of application No. 09/310,629, filed on May 12, 1999, now abandoned.

(51) Int. Cl.[7] ..... B63C 13/00
(52) U.S. Cl. ..... 114/344
(58) Field of Search ..... 114/344; 280/414.1, 280/414.2

(56) References Cited

U.S. PATENT DOCUMENTS

| | | | | |
|---|---|---|---|---|
| 2,437,736 A | | 3/1948 | Good | |
| 2,622,893 A | * | 12/1952 | Wasserlein | 280/47.331 |
| 2,632,655 A | | 3/1953 | King et al. | |
| 2,831,203 A | | 4/1958 | Kanarr | |
| 3,095,585 A | | 7/1963 | Thomas | |
| 3,158,881 A | | 12/1964 | Clausen | |
| 3,537,117 A | | 11/1970 | Plesnevich | |
| 3,612,566 A | | 10/1971 | Shell | |
| 3,841,662 A | | 10/1974 | Howell | |
| 4,180,881 A | | 1/1980 | Speranza | |
| 4,480,578 A | | 11/1984 | Fisher et al. | |
| 4,515,102 A | | 5/1985 | Kury | |
| 4,706,983 A | | 11/1987 | Griswold | |
| 5,042,417 A | | 8/1991 | Raymond | |
| 5,072,959 A | | 12/1991 | Marullo | |
| 5,769,021 A | | 6/1998 | Schad | |
| 5,813,687 A | * | 9/1998 | Lay et al. | 280/414.1 |
| 5,975,003 A | | 11/1999 | Manson | |

* cited by examiner

*Primary Examiner*—S. Joseph Morano
*Assistant Examiner*—Andrew Wright
(74) *Attorney, Agent, or Firm*—Malin, Haley & DiMaggio, P.A.

(57) ABSTRACT

A combined boat-trailer apparatus including a boat with a moveable transportation device for land transport. The apparatus is comprised of at least one longitudinal and one cross-strut built into the boat, a hitch for connection to a towing vehicle, and two laterally mounted wheel suspensions, with wheels. The design of the present invention allows for quick modification of a boat for use on land, thereby eliminating the need for a separate trailer.

3 Claims, 11 Drawing Sheets

COMBINED BOAT-TRAILER APPARATUS

CROSS REFERENCE TO RELATED APPLICATIONS

This application is a continuation-in-part of application Ser. No. 09/310,629 filed May 12, 1999 now abandoned.

BACKGROUND OF THE INVENTION

1. Field of the Invention

This invention refers to a conventional boat including a bow and a stern and having a transportation device with wheels for the land-transport of such a boat integrated within the boat structure.

2. Description of Related Art

Traditionally, a boat's trailer is used for land transport. These trailers are known to have a chassis of considerable size, so that after unloading the boat, a large parking area is needed, which leads to waste of space and unnecessary acquisition or renting cost. Should it be necessary to retrieve the boat at another location, the trailer has to be brought there first.

The present invention alleviates problems found in the prior art by providing a boat having a land trailer structure integrated into the boat hull itself to provide access to road travel. The wheels can be stored out of the way when the boat is in use along with a trailer tongue for the trailer hitch adjacent the bow area.

U.S. Pat. No. 4,515,102 issued to Kury, May 7, 1985, (herinafter "the '102 patent), shows a combination boat and trailer that includes an exterior wheel structure and trailer hitch. One of the drawbacks of this device disclosed in the '102 patent is that the wheels are permanently mounted on the outside of the boat and could interfere with fishing or other activities along the side of the boat during the boating operation. Further, individual springs and shock absorbers are provided for each wheel housing.

The present invention provides a boat-trailer apparatus in which the boat structure itself includes spring action for the wheels during road travel while in the boating position. The wheels are integrally folded into the boat and out of the way. In an alternate embodiment of the present invention, the wheel structure may be removed from the boat hull completely while the boat hull still retains a spring-like structure for use with the trailer wheels.

BRIEF SUMMARY OF THE INVENTION

A combination boat and trailer assembly permitting the boat to be pulled behind a vehicle, including a pair of wheels that can be mounted, one on each side of the boat, and a trailer hitch and tongue mounted to the bow of the boat that are integrated with the boat structure.

A wheel housing, one on each side of the boat, is pivotally attached along the rail of the boat so that each wheel on each side has two positions; one which is extended outside the boat for land travel, and the other which is extended inside the boat and out of the way, during boat operation.

Each of the wheel housings include a rigid frame, a bracket that includes a rotatable pin attached at one end of the rigid frame, and an axle for receiving the wheel and a vertical spring.

Attached to the boat hull, along the water line, is an elongated metal leaf spring permanently attached at the front end to a side rail on the boat extending from the bow to the stern and at its opposite end to a slot defined in the wheel housing frame. Each leaf spring on each side that is attached to the boat permits downward movement of the wheel and wheel housing for spring action during road travel. However, because of the slot inside of the wheel frame, the entire wheel housing can pivot and rotate about the rotating pin and slide out from the leaf spring. The frame has a slot that receives the end tip of the leaf spring. Each wheel housing and frame also includes a locking pin that locks the wheel frame directly to the boat hull water line strip. Through the use of this system, the wheel housing on each side of the boat can be locked on the outside of the boat for road travel, includes spring action for safety on each wheel, and can be easily retracted through pivoting to the inside of the boat during boat operations.

Attached to the bow of the boat is a tongue that includes a trailer hitch that extends forward of the bow and may be L-shaped to extend downward so that it is aligned to fit at the appropriate bumper level of a car or truck that includes a bumper hitch or other suitable hitch for towing the boat and trailer combination.

It is an object of this invention to provide an improved combination boat and trailer that has integral trailer wheels, formed therein, and that allows the trailer wheels to be easily pivoted from a position outside the boat, to one within the boat.

Another object of the invention is to provide an easily removable or attachable set of boat trailer wheels, one on each side of the boat, that can be adapted for use with a boat, and that includes spring action on the wheels.

The present invention features as its major advantage a transportation device that is attached to a boat. The present invention consists of at least one longitudinal strut, one cross-strut, two wheels which can easily be mounted and dismounted to the cross-strut, and a detachable hitch affixed to a towing vehicle.

The major advantage of the present invention is that no separate trailer is needed. The trailer device is integrated into the boat and provides a much lighter and more compact device. The trailer device functions as an additional strengthening strut for the boat. The wheels and the hitch can be easily removed from the transport position when the boat is in the water. They can be stored in the boat or the towing vehicle and should it be necessary to bring the boat ashore, a conversion for land transport is possible immediately.

According to its special design, the cross-strut has an extension on each of its sides, reaching to the upper end of the boat's side wall at which the axle for the wheels (which is removable) is mounted.

In this way, a suitable assembly is possible, avoiding any technical problems with the boat in the water.

Another advantage of the present invention is the form of the longitudinal strut, which has an end portion that matches the form of the bow where the removable hitch is mounted. This construction allows a safe power transmission when towing the boat.

The present invention also describes a transportation device for a boat, having a land-transport apparatus to be installed in the boat. It consists of at least one longitudinal and one cross-strut, and at least two wheels, which are mounted to each side of the cross-strut and which are detachable, and a hitch to connect it to a towing vehicle, which is also detachable.

In accordance with these and other objects which will become apparent hereinafter, the instant invention will now be described with particular reference to the accompanying drawings.

PREFERRED EMBODIMENT OF THE INVENTION

Figure 1:
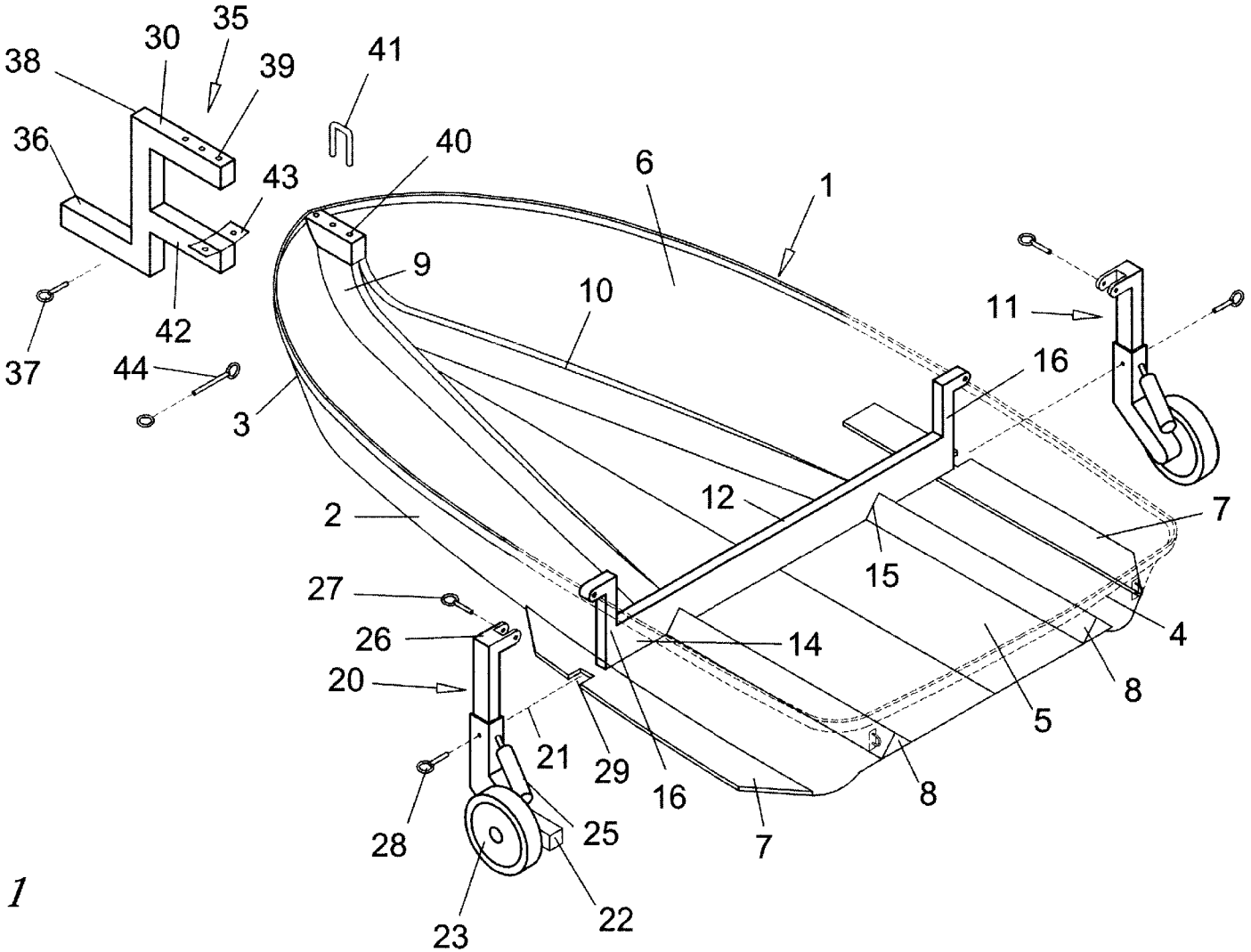
FIG. 1 shows a perspective view of one embodiment of Applicant's invention partially cut away.

The boat 1 in FIG. 1 has a boat-body 2 with bow 3, stern 4, boat bottom 5, and boat side walls 6, which are laterally extended with gliders 7 at the rear part of the boat. The boat bottom 5 is stabilized on the inside with a longitudinal strut 10 consisting of two strut-ribs 8 which are molded to the form of the boat bottom 5 and are held together by longitudinal gluing. The strut ribs 8 meet at the bow 3 and therefore provide one single inner bow support.

The boat also has a cross rib 12 which is fitted into the notches of the strut ribs 15 and stretches across the entire boat bottom 5 between the two side walls 6. On both sides, the cross rib 12 is extended to the top of the side boat walls by extension strut 16. The purpose of extension strut 16 is to provide additional support for the side walls 6 and to hold the wheel suspension 20.

The wheel suspension 20 consist of a telescopic vertical support beam 21 attached to a revolving horizontal support beam 22 on which the wheel 23 is revolvably mounted and a shock absorber 25 mounted between the vertical 21 and the horizontal 22 support beams. At its angled top part 26, the vertical support beam 21 is detachably mounted by inserting a bolt 27 through an aperture in top part 26 and extension strut 16 of the cross-strut 12, and also by screwing a bolt screw 28 into the lower part of the sidewall 6. The bolt screw 28 is connected to the glider 7 where it fits into a notch 29 in the glider 7. In this way, the wheel suspension 20 can be attached to the boat very quickly to provide land transport. If the boat is in the water, the wheel suspension can be easily detached and shortened via use of the telescopic support beam 21 and conveniently stored in the boat or the towing vehicle.

At the bow 3 of boat 1, a hitch 35 affixed to a towing vehicle is removably mounted. This hitch 35 consists of a shaft 36 which can be mounted to a double-armed connector 38 with a bolt 37. The upper arm 39 of the connector fits into a pipe socket 40 which is attached to the bow support 9 and is held in socket 40 by a U-bolt 41. The lower arm 42 is held by two side pieces onto bow 3 and is connected to bow 3 by bolt 44.

The double attachment with the double-armed connector 35 allows for a safe connection to bow 3 because the coupling powers are distributed to the upper and lower bows. If detached, the shaft 36 and the connector 38 are separate and can be stored in the smallest space in the boat or the towing vehicle. The two strut ribs 8 and the cross-strut 12 are best included when the boat is assembled, but can also be installed into the boat's body 2 after assembly.

The transportation device 11 consisting of longitudinal and cross-struts, wheel suspensions and hitch, makes the buying of a trailer, which takes up large amounts of parking space, unnecessary. The mobile parts of the transportation device 11, i.e. wheel suspensions and hitch, can be stored in the boat or the towing vehicle in a small space and are thus always ready for land transport. The longitudinal and cross-struts inserted into the interior of the boat function as the chassis of the land-vehicle and as a useful support for the floating boat body.

Figure 2:
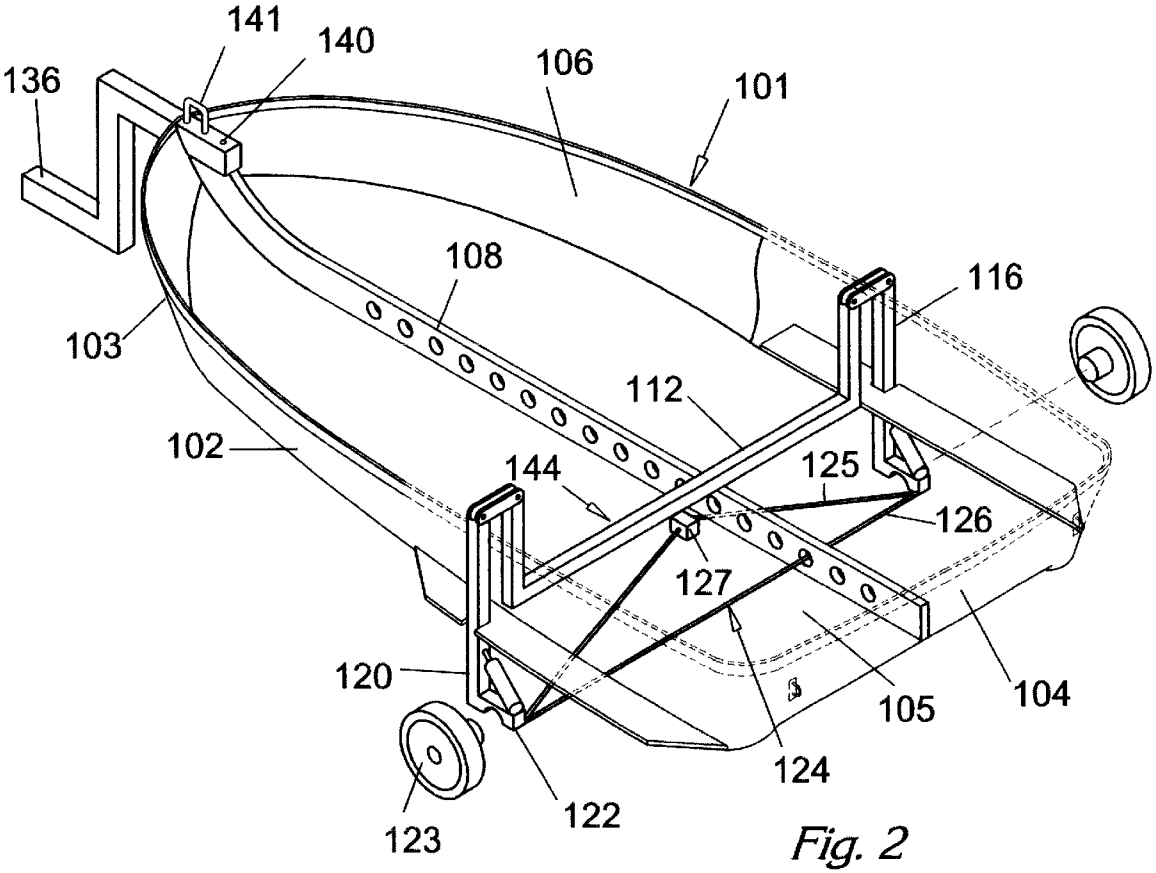
FIG. 2 shows a perspective view of Applicant's invention.

The example shown in FIG. 2 refers to a boat 101 with a boat-body 102, a bow 103, a stern 104, boat bottom 105, and side boat-walls 106. One single support beam 108 is glued to the center of the inner boat bottom 105 and stretches form the bow 103 to the stern 104. The cross-strut 112 is designed as a U-shaped frame where at its end pieces 116, the wheel suspensions 120 are detachably connected with bolts. The wheel suspensions 120, which are identical to those described above and depicted in FIG. 1, hold the wheels 123 and are connected with each other and with the boat's body 102 with a stabilization triangle 124. This triangle consists of two pole members 125, which connect the horizontal support bars 122 of the wheel suspension 120 with the central keel wing 127 of the boat, and a third pole 126 aligned between the outer ends of poles members 125. As seen clearly in FIG. 2, a shaft arm 136 is detachably inserted into a pipe socket 140, which is installed at one end of the support beam 108, at bow 103, and is secured with a U-bolt 141.

Figure 3A:
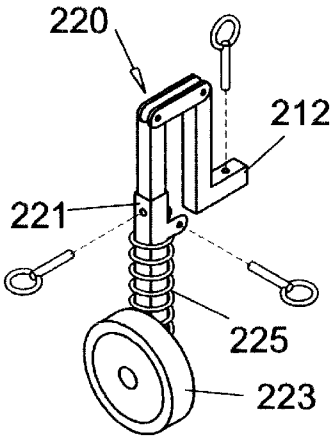
FIG. 3*a* shows a perspective view of one wheel assembly used in the present invention, in the extended road position.
Figure 3B:
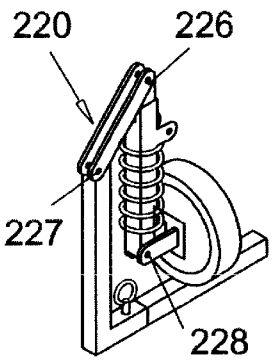
FIG. 3*b* shows the retracted position of the wheel for boat operation.

FIGS. 3*a* and 3*b* show an alternate embodiment of the wheel suspension of FIG. 1 with the additional capability of being foldable. In this embodiment, the vertical support beam 221 holds the wheel 223 with a common spring 225. Vertical support beam 221 can be telescopically shortened and via rotation around two hinges 226 and 227, folded into the inner boat as seen in FIG. 3*b,* at which the wheel 223 is turned around the hinge 228. This arrangement makes it possible to detach the entire wheel suspension from its position and store it inside the boat without removing it from cross strut 212. If necessary, a trunk can be installed into the boat for this purpose.

The examples described above do not limit the scope of the present invention, but instead illustrate alternate embodiments which address various needs. For example, a larger number of strut ribs can be used. These can be installed into the boat's side walls during assembly. For larger boats, it is possible to use two cross-struts, each of which can have either a two wheel suspensions or a one wheel suspension and can be installed on each side between the two cross-struts. The design of these various wheel suspensions can vary depending on the weight of the boat. The hitch could be mounted directly to the bow of the boat instead of the longitudinal strut, could be permanently attached if telescopically designed, or could be folded into the boat. Finally, the entire transportation device consisting of longitudinal struts, cross-struts, wheel suspensions, and hitch, can be marketed as an additional or built-in device.

Figure 4:
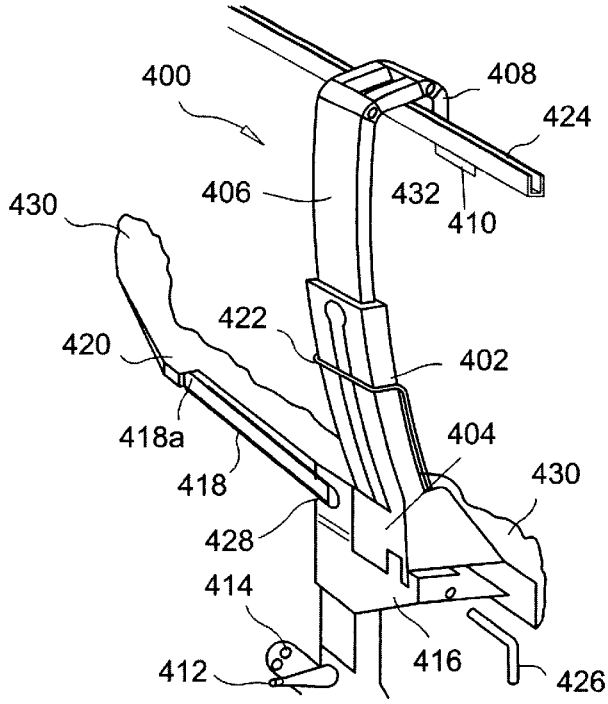
FIG. 4 shows a perspective partial view of one wheel assembly and frame utilized in the present invention as it is integrated to a portion of the boat hull structure.

Referring now to FIG. 4, an alternate embodiment of the present invention is shown, which includes a structural change or modification to boat 430 and a wheel-retaining housing and frame 400. The wheel frame 400 is permanently attached to a boat gunner 424 by a pivot pin 432 and a bracket 410 that is affixed to the rail of boat 430. A substantially rigid, vertical support frame member 406 is attached to a secondary frame member 402 that supports a wheel (not shown) on an axle 412 connected to wheel holder 414 and axle connector, all of which are rigidly attached to central frame member 416 which is movably separable from the above frame member 404.

A leaf metal spring 418 is permanently attached to hull protrusion 420 which protrudes, in this case, from the port side of the boat, and has steel leaf spring 418 permanently attached at one end to hull protrusion 420. Thus, the spring 418 is actually part of the boat hull structure and is attached at 418*a* to hull protrusion 420. The spring 418 can move vertically up and down and is free to move at the end that is connected in a slot 428 that is part of the lower frame 416 attached to the wheel axle 412.

The purpose of spring 418 is to allow for upward and downward spring and shock movement for a tire and wheel attached to axle 412 during the mode of operation when the wheel and wheel frame 400, (on the exterior of the boat) are being towed on a wheel on each side of axle 412. The frame 416 and the frame 404 are also attachable along the rear portion of the boat structure. A release mechanism 422 allows the entire unit to be pivoted upwards and stored inside the boat.

For boat operations, once the unlock mechanism 422 has been pulled down, the entire frame 400, including frame 402, 416, the wheel housing 414 and the axle 412 (which would have a wheel on it) is disengaged from slot 428 and disengages spring 418 allowing the entire wheel housing to pivot about pivot pin 432 and pivot mechanism 408 approximately 340°, thereby allowing the entire unit to be disposed within the boat. A locking pin 426 can also be used to lock the mechanism and entire wheel support from wheel frame 400 to the boat 430 during the trailer operations.

Figure 5:
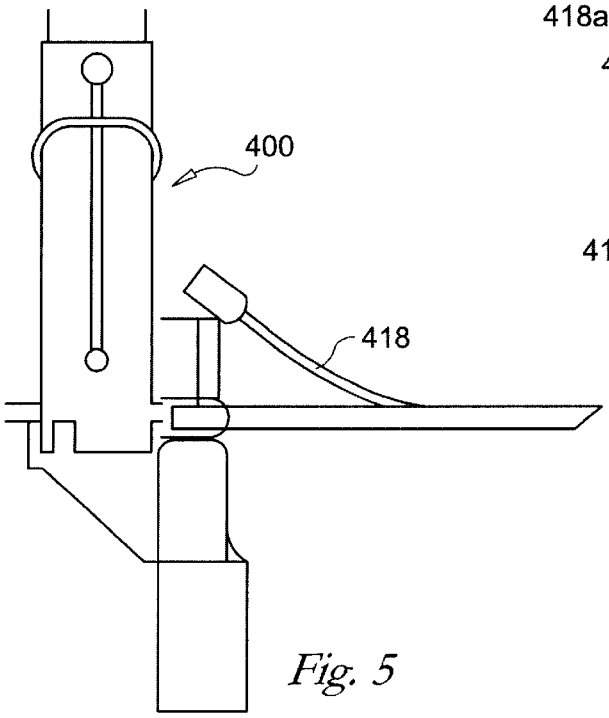
FIG. 5 shows a front side elevational view of the alternate embodiment shown in FIG. 4 and shows the spring action featured in the present invention.
Figure 6:
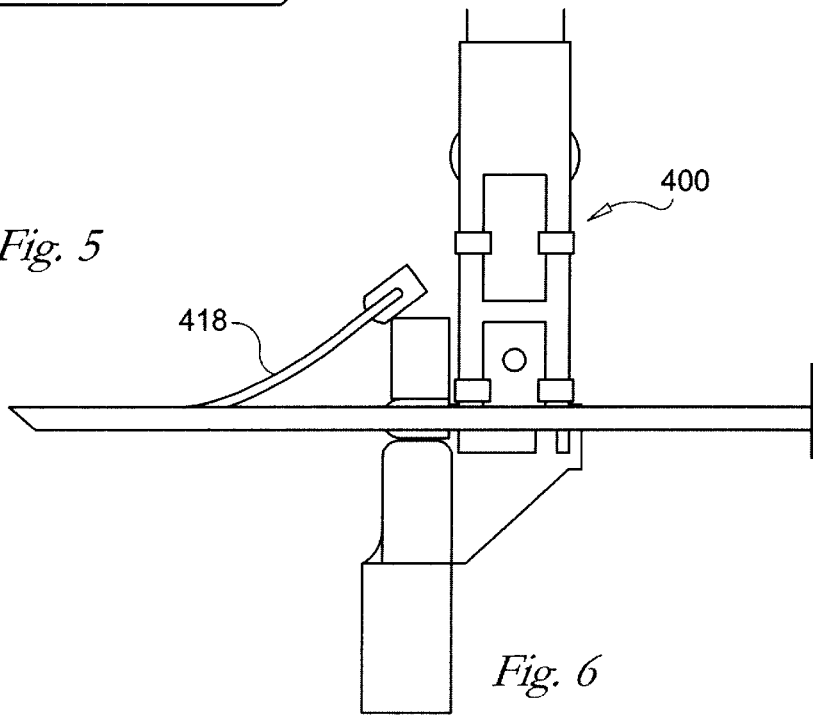
FIG. 6 shows a back elevational view of the alternate embodiment of the invention shown in FIG. 4.

FIGS. 5 and 6 show side elevational views of the boat wheel assembly 400 and an extension of spring 418 in its operating position to allow the wheel movement which performs and acts like a shock absorber or spring to prevent increased or unusual vibration or force directly on the wheel.

Figure 7:
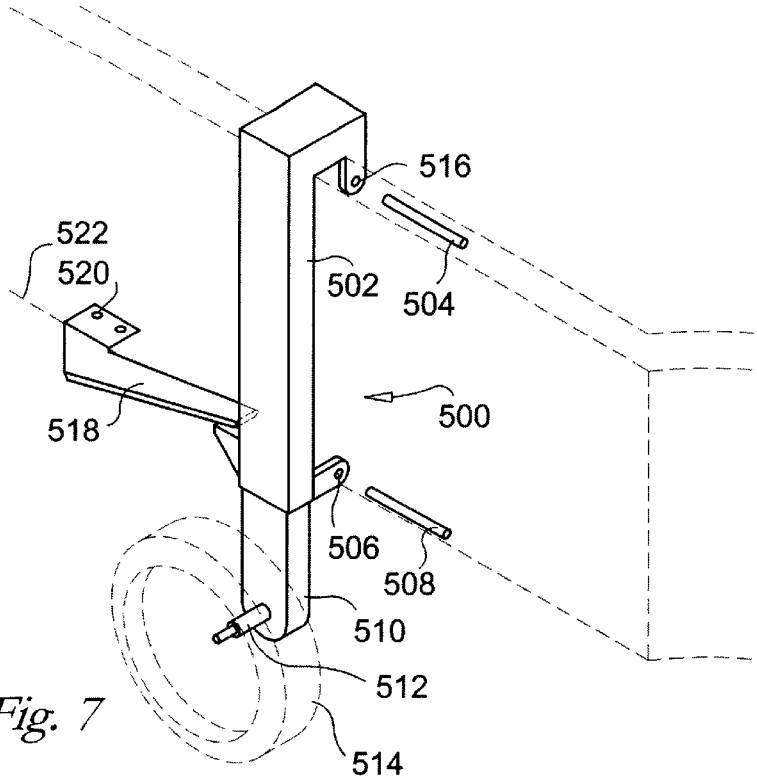
FIG. 7 shows an alternate embodiment of the present invention that includes a retractable wheel and frame assembly that can be removed from the boat while still including a spring structure.

FIG. 7 shows yet another embodiment of the invention that includes a removable frame and wheel assembly 500 that can be removably attached to the outside of a boat hull. Thus, a rigid frame member 502 that includes a pair of apertures 506 and 516 can be attached by pins 504 and 508 to a boat hull represented by 522. The frame itself includes an additional telescopic frame member 510 that is attached to an axle 512 that holds wheel 514. Again, a spring 518, which is a flat, flexible band of metal, is permanently attached by flange 520 to boat 522. The spring 518 can be attached, although not necessarily permanently, to the frame 500 and spring platform 524 which permits upward and downward movement of the wheel housing in frame member 510 as spring 518 pushes against the spring platform 524.

Figure 8:
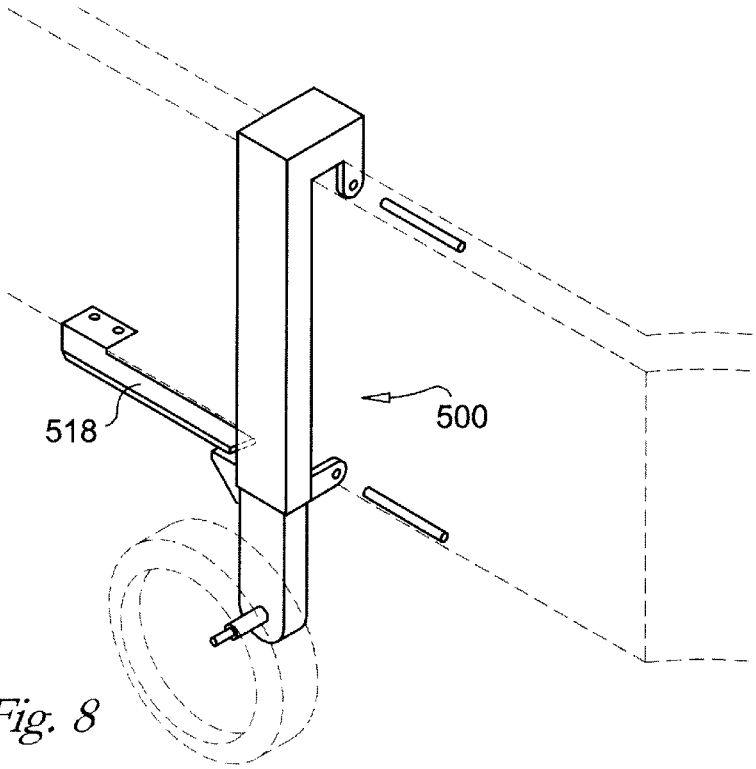
FIG. 8 shows the retractable wheel and frame assembly of FIG. 7 with the spring structure at a different angle.
Figure 9:
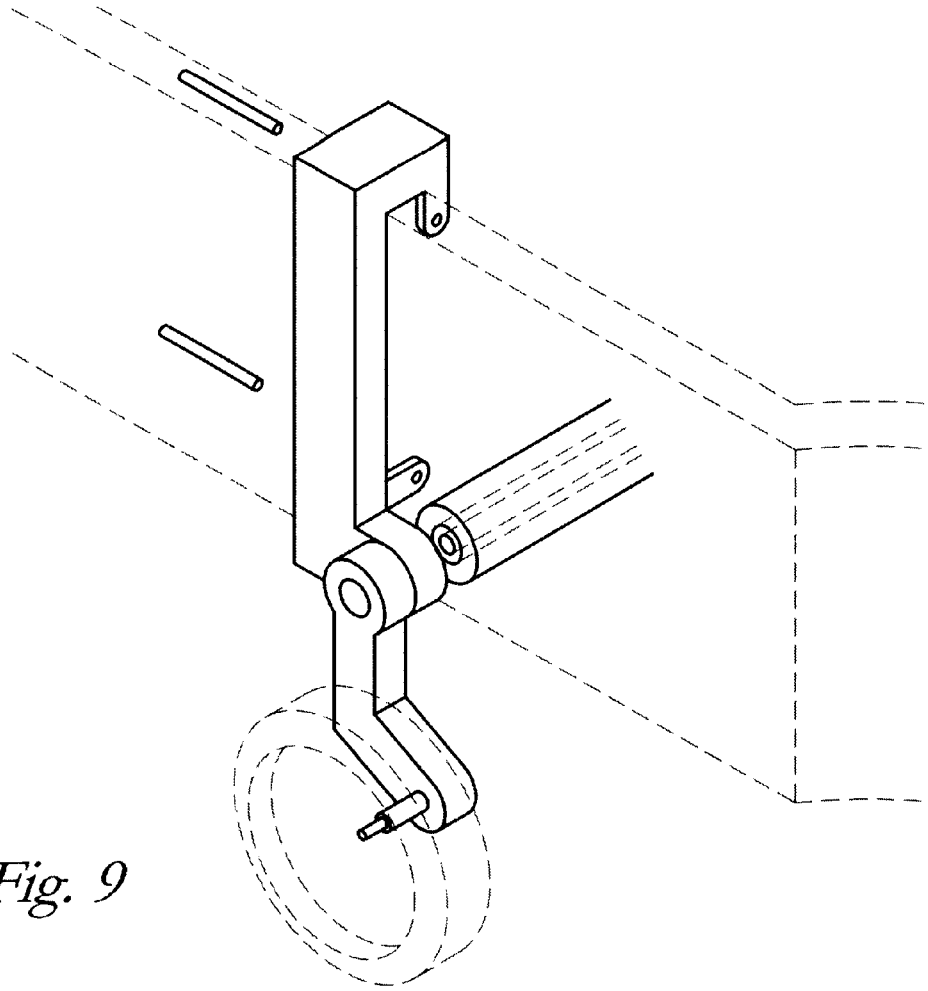
FIG. 9 depicts another embodiment and shows an alternate configuration of the retractable wheel and frame assembly.
Figure 10:
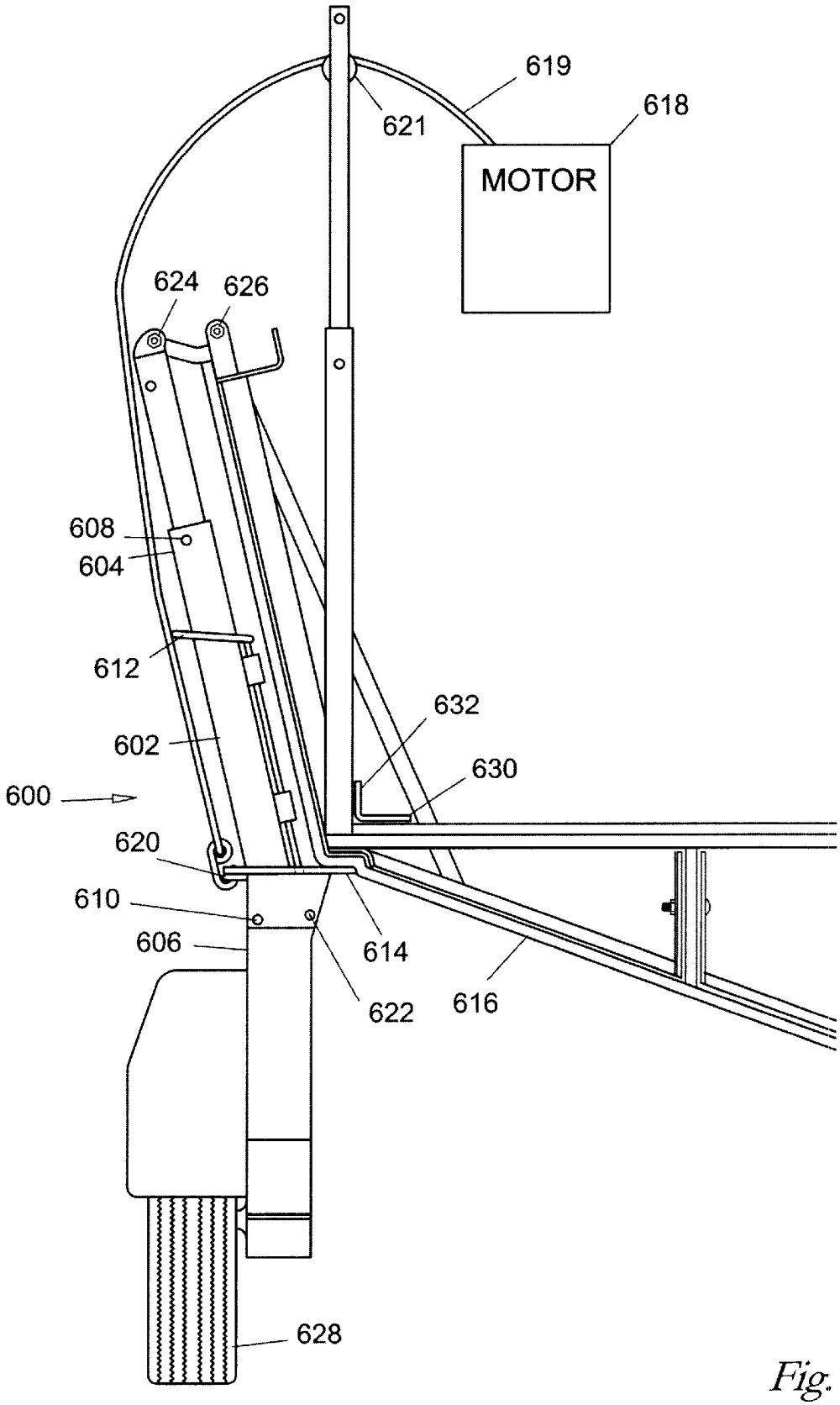
FIG. 10 shows a front view of another embodiment of the present invention including a telescoping and hinged support beam.
Figure 11:
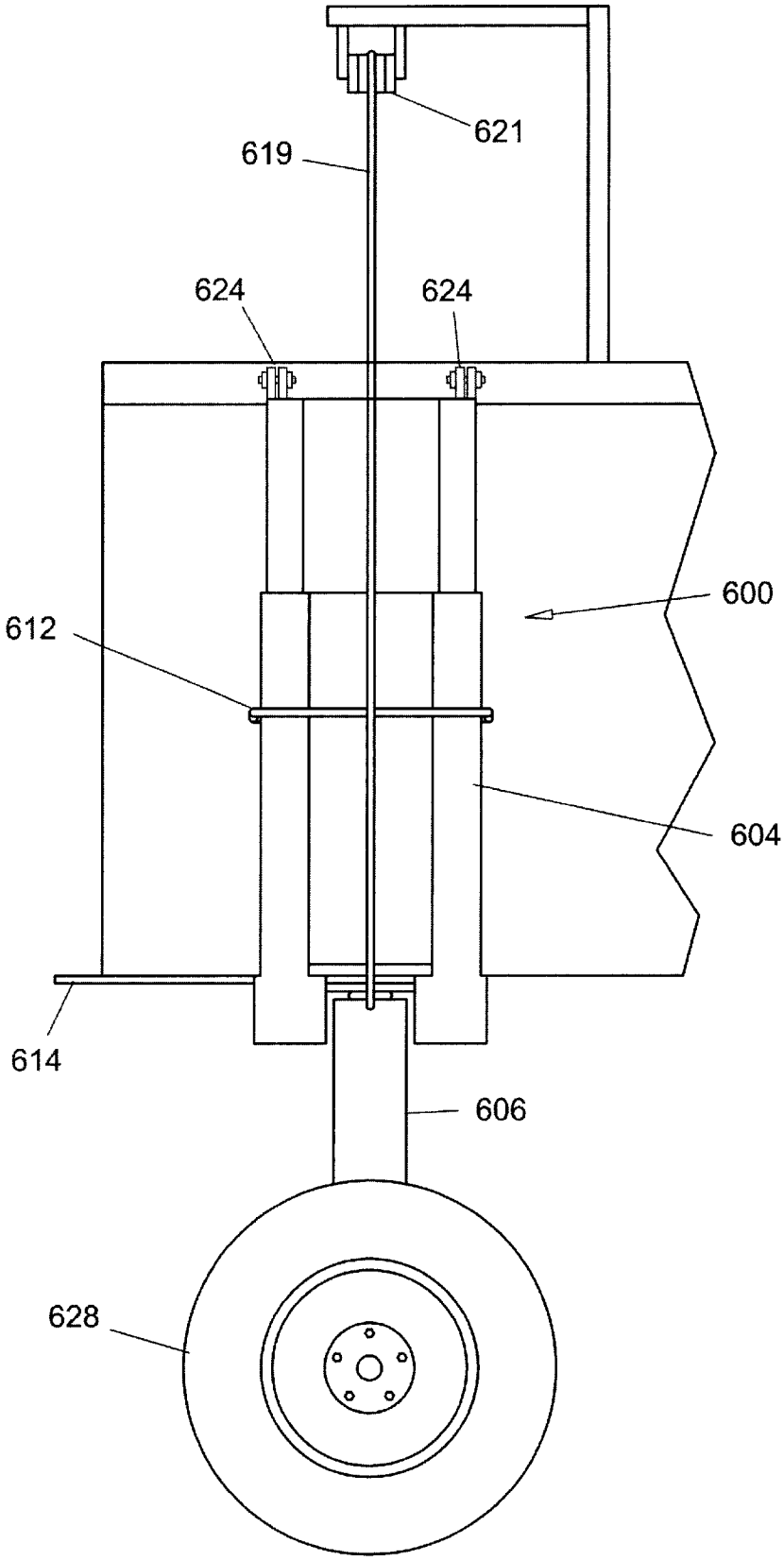
FIG. 11 shows a side view of the embodiment in FIG. 10.
Figure 12:
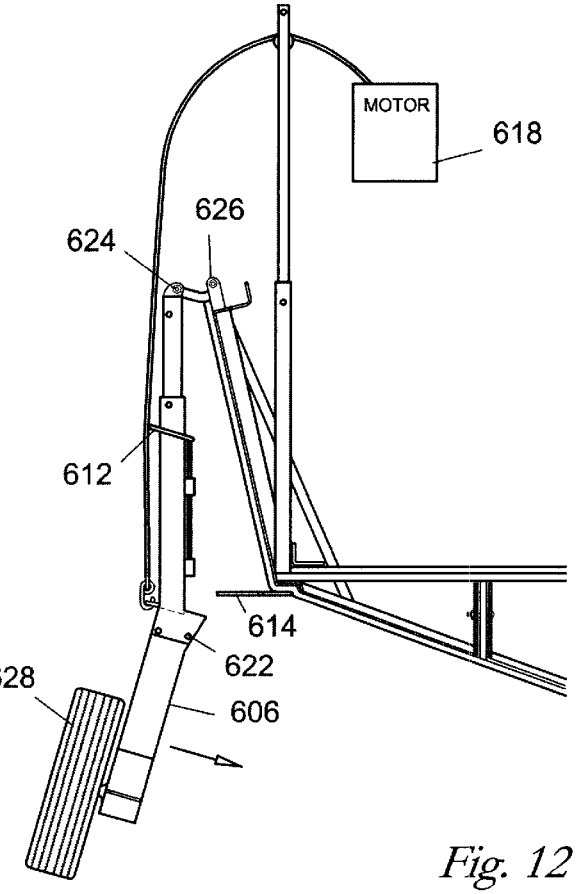
FIG. 12 shows a front view of the embodiment in FIG. 10 with the wheel assembly detached from a glider on the boat.
Figure 13:
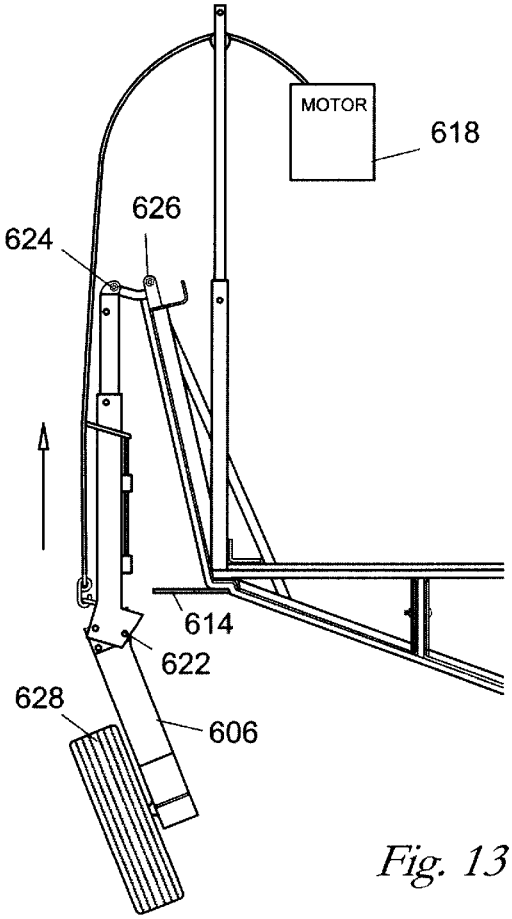
FIG. 13 shows a front view of the embodiment in FIG. 10 with a bottom pin removed.

When the boat is to be used in the water, and the trailer operation is finished, the wheel housing 500 can be removed by pulling out pins 504 and 508, and removing the entire frame and wheel. The spring 518 will remain permanently attached to the boat. FIG. 8 shows the same embodiment in FIG. 7 with the spring 518 at a different angle. FIG. 9 shows another embodiment with complementary attachment between the boat, an upper portion of the frame member and a lower portion of the frame member, whereby the lower portion of the frame member may fold complementarily with the upper portion.

FIGS. 10–19 show still another embodiment of the invention. In this embodiment, the wheel assembly 600 comprises a support beam 602 with an upper portion and a lower portion 606. In this embodiment, the upper portion 604 of the support beam 602 telescopes from an extended position to a retracted position and back again. Preferably, a top pin 608 or similar securing means such as a nipple and hole configuration is capable of locking the upper portion 604 in the extended or retracted position. As shown in FIGS. 13–19, the lower portion 606 is hingeably attached to the upper portion 604 so that the lower portion 606 may be collapsed against the upper portion 604. It is also preferred that a bottom pin or similar securing means such as a nipple and hole configuration is capable of securely locking the lower portion 606 to the upper portion 604.

Furthermore, in an alternative embodiment it is preferred that a locking mechanism 612 attached to the upper portion 604 will secure the support beam 602 to the boat 616 at a glider 614 extending outward from the boat 616, so that the wheel 628 is at an optimal angle for pulling the boat 616 on land. A motor 618 and rope 619 and pulley 621 or similar pulling means such as a strap may attach to the lower end 620 of the upper portion 604 of the support beam 602 for pulling the support beam 602 aboard the boat 616.

Figure 14:
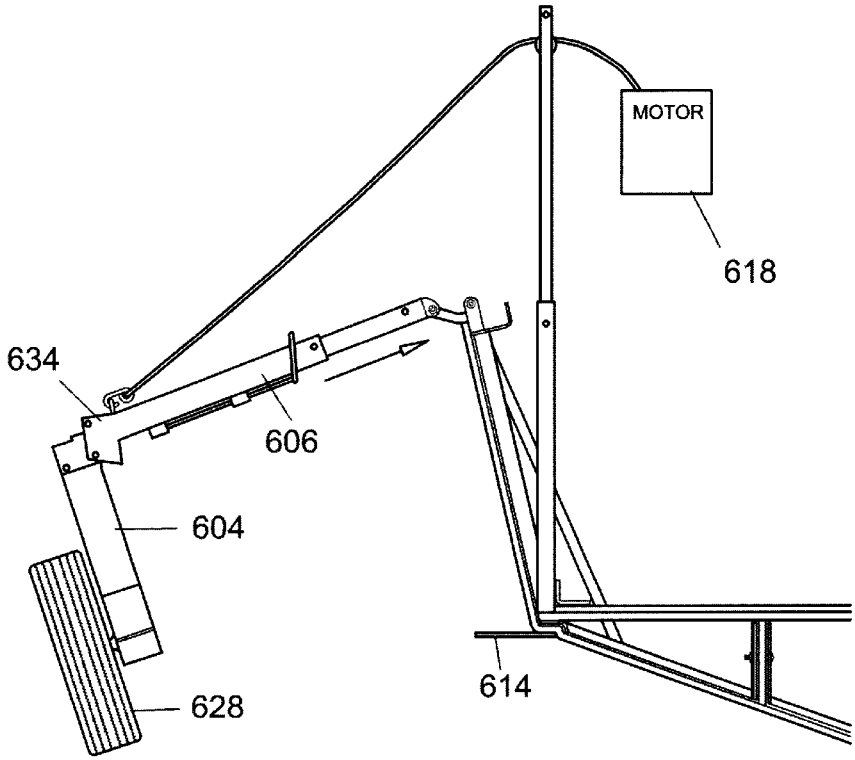
FIG. 14 shows a front view of the embodiment in FIG. 10 with the lower portion of the support beam partially collapsed against the top portion of the support beam.
Figure 15:
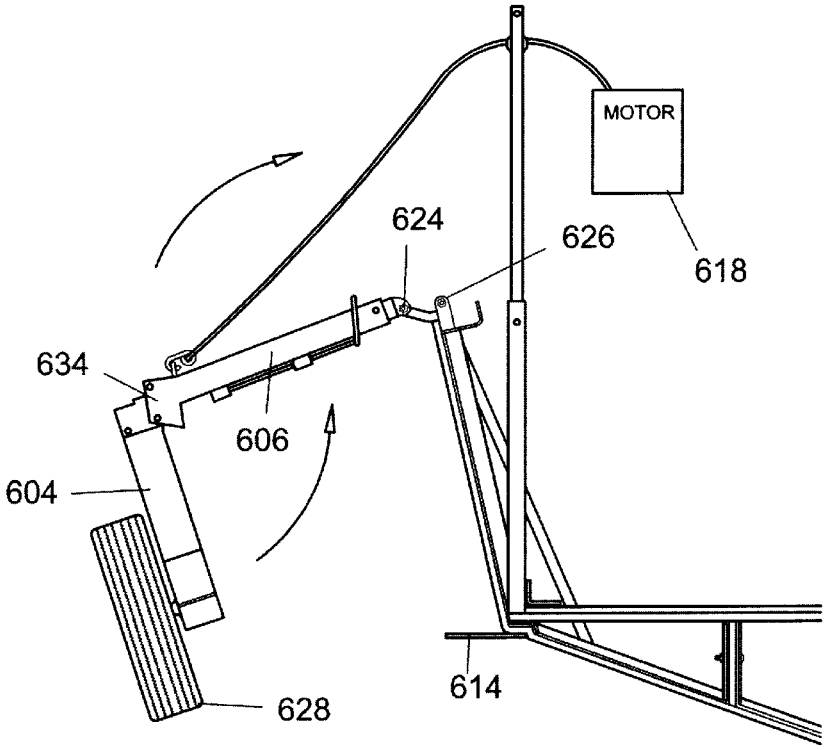
FIG. 15 shows a front view of the embodiment in FIG. 10 with the top portion of the support beam retracted.
Figure 16:
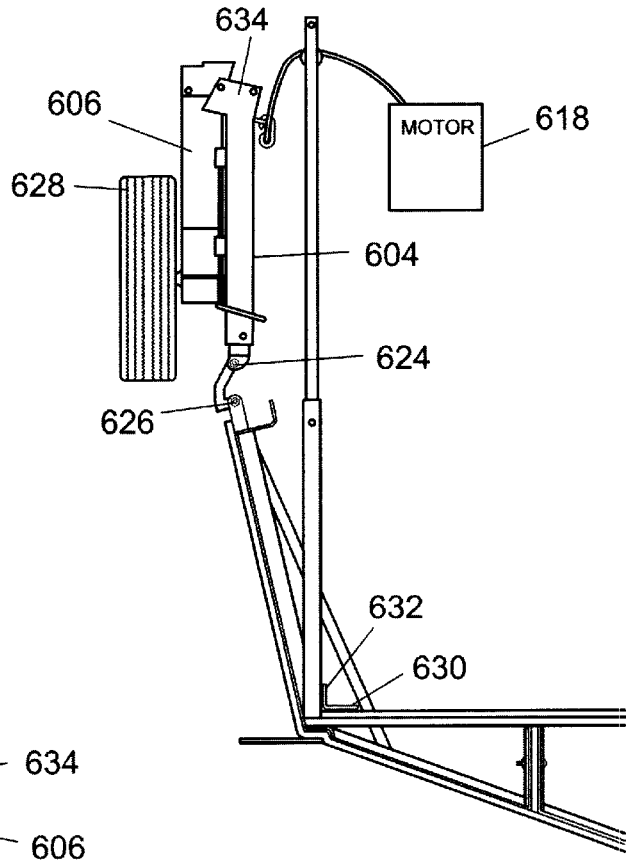
FIG. 16 shows a front view of the embodiment in FIG. 10 with the bottom portion of the support beam collapsed against the top portion.
Figure 17:
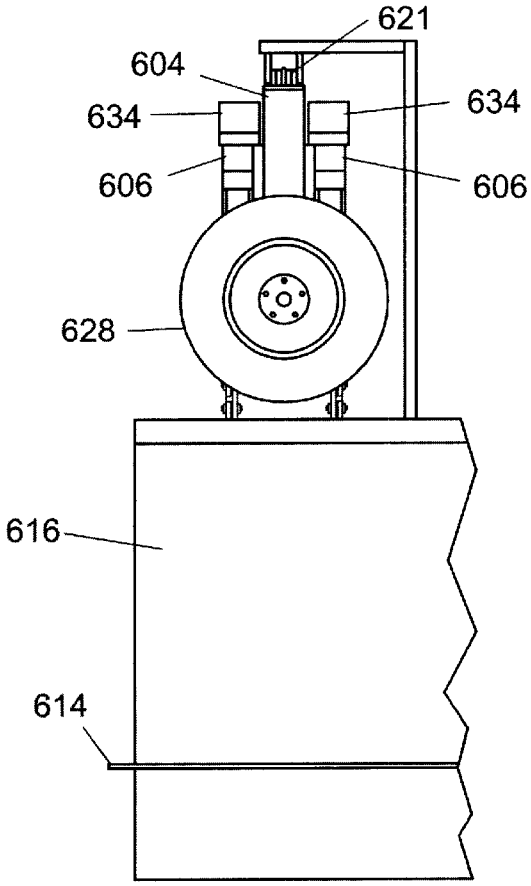
FIG. 17 shows a side view of the embodiment in FIG. 10 with the bottom portion of the support beam collapsed against the top portion.
Figure 18:
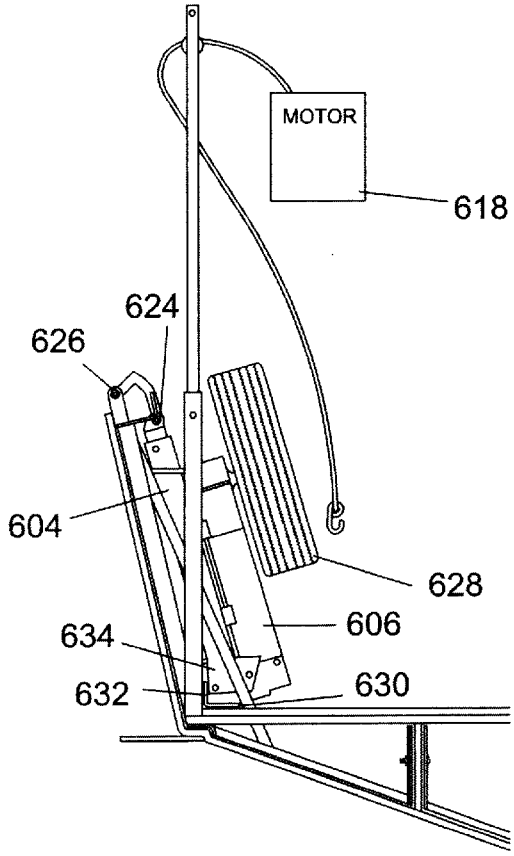
FIG. 18 shows a front view of the embodiment in FIG. 10 with the collapsed and retracted support beam aboard the boat.
Figure 19:
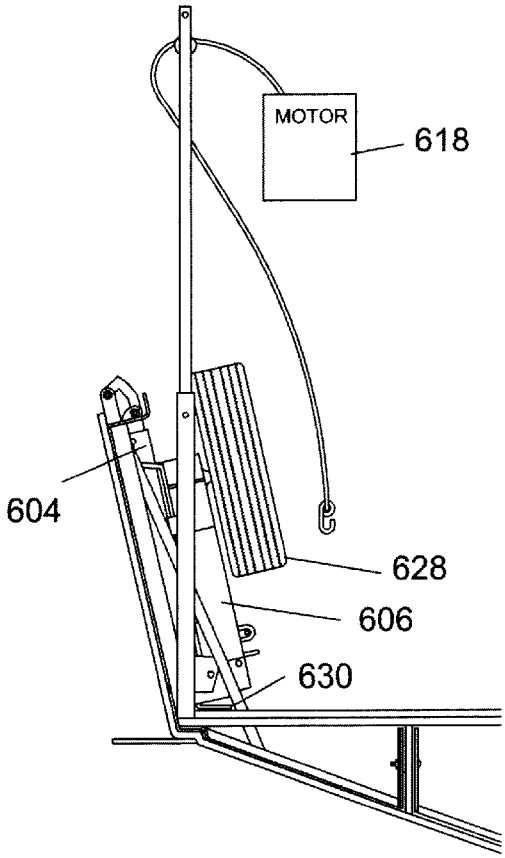
FIG. 19 shows a front view of the embodiment in FIG. 10 with the collapsed and retracted support beam secured aboard the boat.

This embodiment of the invention is used as follows. A locking mechanism 612 is released when the boat is at least partially afloat, allowing the wheel assembly 600 to separate from the glider 614. The top pin 608 and the bottom pin 610 are also released. The upper portion 604 telescopes into the retracted position, as illustrated in FIGS. 14 and 15, and may be secured by replacement of the top pin 608 at a locking point 636. The lower portion collapses against the upper portion 604 at the hingeable attachment point as illustrated in FIGS. 13 through 16. As shown in FIGS. 16 through 19, the retracted and collapsed wheel assembly 600 is rotated around the side of the boat into the boat via at least two hinges 624, 626. It is preferred that there at least be a near hinge 624 and a far hinge 626. The retracted, collapsed configuration of the wheel assembly permits a person inside the boat 616 to easily access the wheel 628 for purposes such as maintenance, cleaning, repair and replacement. As shown in FIG. 18, the near and far hinges 624, 626 allow the collapsed and retracted wheel assembly 600 to fit snugly against the gunwales of the boat 616. Thus the wheel assembly takes up a minimum of space aboard the boat 616.

In another embodiment of this invention, a means for securing the wheel assembly 600 to the boat 616 is attached to the boat 616. In one embodiment, shown in FIGS. 10 through 19, a bracket 630 with an extension 632 is attached to the bottom surface of the boat 616. As shown, the near and far hinges 624 and 625 permit the wheel assembly to fit closely against the boat 616.

Preferably, the lower end 634 of the top portion 604 of the wheel assembly 600 has an indentation, or is at least partially hollow. Thus, the top end 634 fits complementarily with the extension 632 of the bracket 630, thereby securing the retracted, collapsed wheel assembly 600 to the boat 616. Other means for securing the wheel assembly 600 to the boat 616, such as ties or covers that snap with attachment points inside the boat 616 are also contemplated.

By using the present invention, a very efficient and non-complex apparatus can be utilized that can be permanently attached to a boat, that can rotate from the outside of the boat to inside of the boat and out of the way, or can easily be removed from the outside of the boat for boating operations. The invention includes a built-in simple spring mechanism so that during road travel, sufficient spring and shock absorbing will be available to the wheels as the boat is towed so that damage does not occur to the boat.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combined boat-trailer apparatus for affixing to a towing vehicle, said apparatus comprising:

a boat body having a front bow portion, a rear stern portion, first and second side walls, each first and second side wall having an inside and an outside portion, a boat bottom having a top surface and a bottom surface, said first and second side walls and said boat bottom defining a boat interior portion;

a first wheel support assembly and a second wheel support assembly, said first wheel support assembly being attached to said boat body first side wall, and said second wheel support assembly being attached to said boat body second side wall, said first wheel support assembly and said second wheel support assembly being essentially identical in construction, said first and second wheel support assemblies being independently movable relative to said first and second side walls of said boat body;

a first wheel mounted on said first wheel support assembly, and a second wheel mounted on said second wheel support assembly, said first wheel including a first axle connected to said first wheel support assembly and said second wheel support assembly including a second axle connected to said second wheel;

said first wheel support assembly including a first support beam having an upper portion and a lower portion, said first wheel support assembly first support beam upper and lower portions being telescopically movable relative to each other for extending the length from a first position to a second position and a first wheel support assembly second support beam hingedly attached to said first wheel support assembly first support beam, said first wheel support assembly second support beam hingedly attached to said first wheel support assembly first support beam, said first wheel support assembly second support beam being hingedly lockable to said first wheel support assembly first support beam in a first extended position and unlockable and movable approximately 180 degrees relative to said first wheel support assembly first support beam in a second unlocked position parallel to said first wheel support assembly first support beam;

said second wheel support assembly including a second wheel support assembly first support beam having an upper portion and a lower portion, said second wheel support assembly first support beam upper and lower beam portions being telescopically movable relative to each other for extending the length from a first position to a second position and a second wheel support assembly second support beam hingedly attached to said second wheel support assembly first support beam, said second wheel support assembly second support beam being hingedly lockable to said second wheel support assembly first support beam in a first extended position and unlockable and movable approximately 180 degrees relative to said second wheel support assembly first support beam in a second unlocked position parallel to said second wheel support assembly first support beam;

said first wheel and said first axle connected to said first wheel support assembly second support beam;

said second wheel and said second axle connected to said second wheel support assembly second support beam;

a first rigid support member connected to the inside portion of said boat body first side wall;

a second rigid support member connected to the inside portion of said boat body second side wall;

said first rigid support member including an uppermost portion extending above the first side wall of said boat body;

first wheel support assembly near and far hinges connected to said first wheel support assembly first support beam and said uppermost portion of said first rigid support member;

said second rigid support member including an uppermost portion extending above the second side wall of said boat body;

second wheel support assembly near and far hinges connected to said first support beam of said second wheel support assembly and said uppermost portion of said second rigid support member;

said first wheel support assembly being mountable in a first position locked to the outside portion of said first sidewall of the boat body, extended to act as a trailer wheel for the boat and, in a collapsed second position, said first wheel support assembly first support beam and said first wheel support assembly second support beam being pivotally hingedly collapsed and parallel to each other and mounted in a parallel position inside the boat, parallel to said boat body first side wall; and said second wheel support assembly attached to said boat body second side wall being hingedly movable by said second rigid support member near and far hinges from a first extended position outside of said boat to act as a trailer wheel to a second collapsed storage position inside of said boat, said second wheel support assembly being parallel to said boat body second side wall and said second wheel parallel to said second wheel support assembly second support beam in said collapsed position.

2. A combined boat-trailer apparatus as in claim 1, including a first, rigid, triangular frame structure mounted inside said boat body and connected to the top surface of said bottom of said boat body and the first side wall of said boat body for rigidly supporting said first wheel support assembly, and a second, rigid, triangular support frame connected to said top surface of said boat bottom and said boat body second side wall connected to said second wheel support assembly for rigidly supporting said second wheel assembly.

3. A combined boat-trailer apparatus as in claim 1, including a motor, a rope attached to said motor, and a means for attaching one end of said rope to each of said first wheel support assembly and said second wheel support assembly independently for retrieving said first wheel support assembly and said second wheel support assembly into said boat in the collapsed positions.

* * * * *